United States Patent [19]

White

[11] Patent Number: 4,886,051

[45] Date of Patent: Dec. 12, 1989

[54] MASSAGING BED

[76] Inventor: Francis E. White, 1437 Panorama Dr., Birmingham, Ala. 35216

[21] Appl. No.: 211,939

[22] Filed: Jun. 27, 1988

[51] Int. Cl.[4] ..... A61H 7/00

[52] U.S. Cl. ..... 128/52; 128/57

[58] Field of Search ..... 128/51, 52, 56, 33, 128/57; 5/216, 217

[56] References Cited

U.S. PATENT DOCUMENTS

| | | | |
|---|---|---|---|
| 2,534,587 | 12/1950 | Fisher et al. | 128/71 |
| 2,841,141 | 7/1958 | Hugins | 128/57 |
| 2,909,173 | 10/1959 | Anderson | 128/33 |
| 3,003,497 | 10/1961 | Nunes | 128/57 |
| 3,039,458 | 6/1962 | Hill | 128/52 |
| 3,205,887 | 9/1965 | Henry | 128/57 |
| 3,812,846 | 5/1974 | Trout | 128/57 |
| 3,882,856 | 5/1975 | Heuser et al. | 128/57 |
| 4,699,126 | 10/1987 | Lancaster | 128/52 |

*Primary Examiner*—Edgar S. Burr
*Assistant Examiner*—Huong Q. Pham
*Attorney, Agent, or Firm*—Jennings, Carter, Thompson & Veal

[57] ABSTRACT

A massaging bed that provides a deep penetrating massage utilizes a narrow tread roller assembly reciprocated by a carriage beneath a flexible cover member. The roller assembly provides essentially point contact with the user's body such that the upward force of the roller assembly is concentrated in a small area which by virtue of the rotation of the roller assembly and reciprocation of the carriage moves laterally and longitudinally in a non-repetitive pattern.

17 Claims, 5 Drawing Sheets

MASSAGING BED

FIELD OF THE INVENTION

This invention relates to massaging beds and in particular to apparatus for massaging the musculature of the back. More specifically the present invention relates to apparatus which stimulate the back muscles through the application of localized pressure along a non-repetitive path over the user's body.

BACKGROUND OF THE INVENTION

Numerous apparatus have been devised to effect a massaging action on the back of a user. Many of these use one or more rollers which extend generally over the width of the back and which are reciprocally driven to roll against the back over a predetermined distance. Others utilize a plurality of smaller rollers or wheels which simultaneously and concomitantly contact and move along the back to provide massaging action. Another group of devices use a single narrow roller to move along the spine and stimulate that region. Yet another type device uses a plurality of slats which extend either laterally or longitudinally and which are synchronously flexed by subjacent rollers to provide a massaging action. A variety of specific roller constructions are known for use in manual and automated massaging systems. While each of the foregoing types of apparatus certainly impart a stimulation to the body, the nature of the stimulation is somewhat ineffective. That is to say the systems known to me only offer stimulation which is so repetitive as to become monotonous and hence loses its effectiveness. Additionally, each of the known devices applies only superficial pressure simultaneously over a large area, thus little penetrating muscle stimulation actually occurs and the benefits of massage are not fully realized.

SUMMARY OF THE INVENTION

It is the object of the present invention to provide a penetrating massage advantageously stimulating the superficial and inner muscle structure.

Another object of the invention is to provide the above type stimulation in a non-repetitive pattern such that all areas within reach of the apparatus are individually stimulated.

Yet another object of the invention is to promote the health and well-being of the user by providing an invigorating and non-monotonous massage.

Still another object is to promote improved muscle tone and circulation in the user by virtue of the penetrating massage.

Each of these and other objects and advantages are accomplished in my invention through the novel combination of elements as claimed herein. My invention may be embodied in apparatus which takes the form of a bed having a flexible supporting cover on which a user may recline. Beneath the flexible cover and supported by a frame is a reciprocating carriage which moves longitudinally along the bed. The carriage carries a roller mechanism which is upwardly biased against the undersurface of the supporting cover so as to apply a predetermined pressure thereto. The roller mechanism includes an arcuate tread which engages the undersurface of the cover in a welldefined area so as to apply point or pseudo-point pressure to the supporting cover. The roller mechanism is further designed such that the pseudo-point pressure is applied over a non-repetitive path that The apparatus embodying my invention is thus capable of providing deep penetrating massage in a non-monotonous pattern. Further, the roller mechanism can be retracted to permit utilization of the bed as a sleep or rest area.

BRIEF DESCRIPTION OF THE DRAWINGS

Apparatus embodying features of my invention are depicted in the accompanying drawing which form a portion of this disclosure and wherein.

DESCRIPTION OF THE PREFERRED EMBODIMENT

Figure 1:
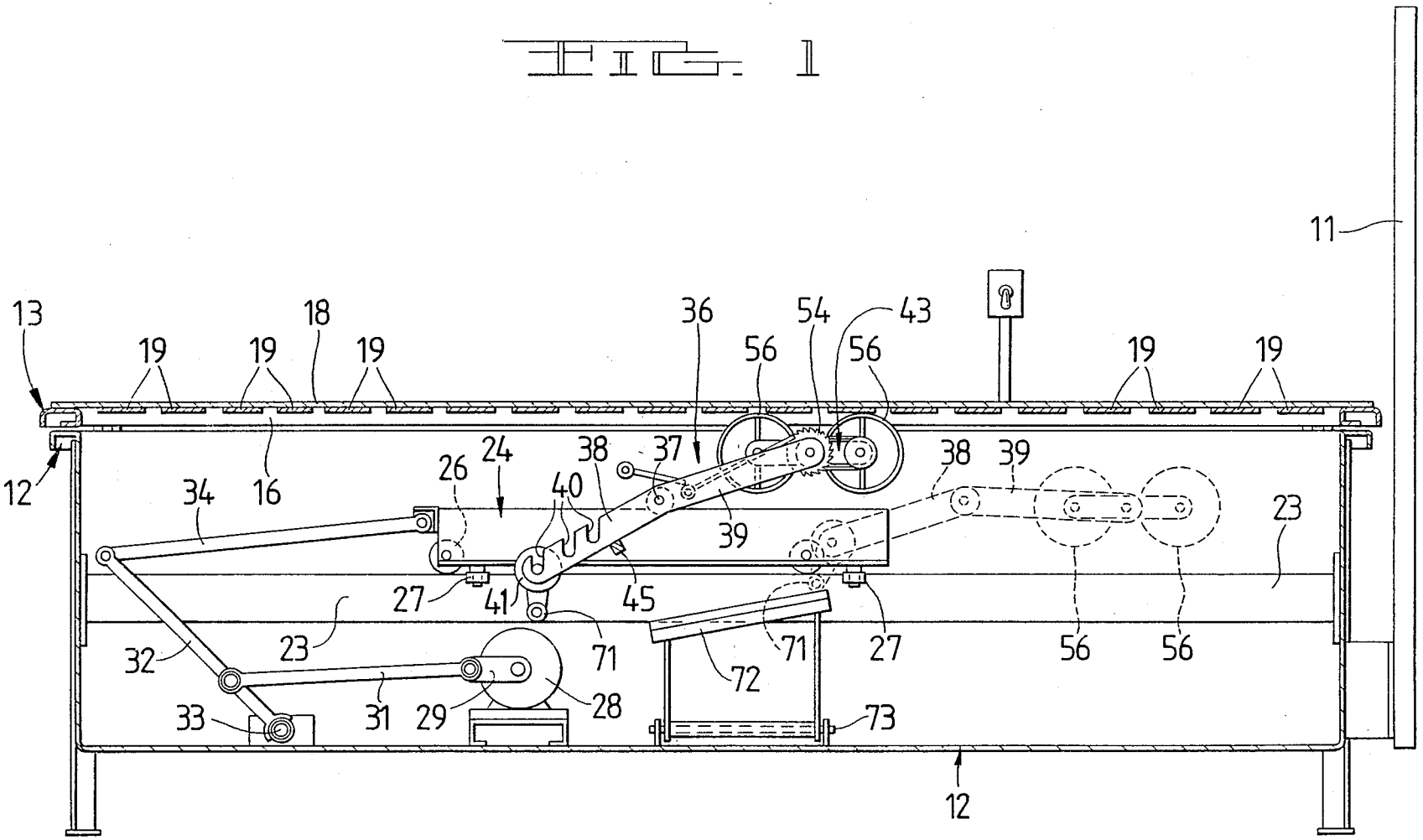
FIG. 1 is a sectional view taken along the longitudinal centerline of my apparatus.
Figure 3:
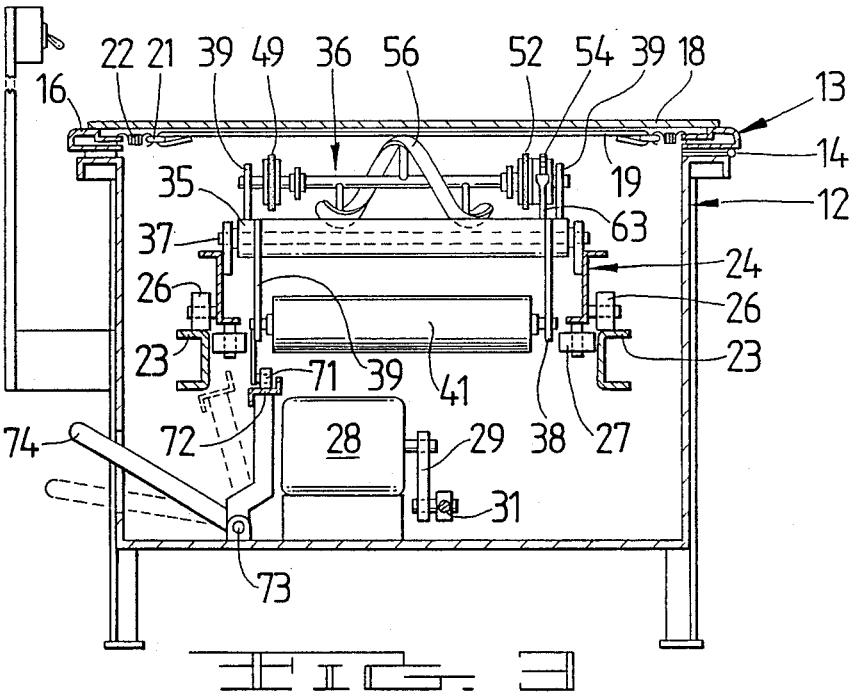
FIG. 3 is a sectional view taken along line 3—3 of FIG. 2.

Referring to the drawings for a more complete understanding of the invention, it will be noted in FIG. 1 that the apparatus may be configured as a bed with a decorative headboard 11 as an option. The bed utilizes a main frame 12 which is a box-like structure and supports the remaining components of the apparatus. The main frame has an open top which is closed by a body supporting cover 13 which is connected to the main frame 12 along one side thereof by hinges 14 as shown in FIG. 3. The body supporting cover 13 has a rigid frame 16 which extends about the upper periphery of main frame 12 and is supported thereon. Attached, as by snaps 17, to the top of the rigid frame 16 is a flexible cover sheet 18 which extends substantially coextensively with the rigid frame 16. Beneath cover sheet 18 are disposed a plurality of wide support straps 19 which extend transversely of the rigid frame 16. Each support strap 19 terminates at each end with a strap hook 21 which is connected to a pair of strap springs 22 which are also connected to the rigid frame 16 such that the support straps 19 are maintained in a flat, taut condition to support the cover sheet and prevent excess deflection thereof when a person lies on the apparatus. The support straps 19 are inelastic and are about three inches wide. The number of straps should be adequate to completely support the user without excess deflection. Of course the size of the springs 22 may be adjusted as desired.

Inside the box-like enclosure formed by main frame 12 and supported thereby are a pair of parallel horizontally disposed rails 23 which extend within the bed from head to foot. The rails 23 support a carriage 24 mounted for movement therealong on a set of wheels 26. A set of guide wheels 27 mounted to the carriage for rotation about a vertical axis engage the rails 23 laterally and serve to keep the carriage 24 on the rails 23. The carriage 24 is reciprocally driven along a portion of the rails by an electric motor 28 the output shaft of which turns a bell crank 29 which is pivotally connected to drive a motor connecting rod 31 which in turn is connected to reciprocate an extension arm 32 through an arc about a mounting shaft 33. The extension arm 32 is connected at its upper end to a carriage connecting rod 34 which completes the mechanical linkage from the motor 28 to the carriage 24.

The carriage 24 supports the massaging roller assembly 36. The roller assembly 36 is supported on a pivot shaft 37 which extends from side to side on the carriage. A torque tube 35 pivots on the shaft 37 and has connected thereto two sets of arms 38 and 39. Counterweight arms 38 support a counterweight 41 in one set of a plurality of sets of slots 40 formed in arms 38. Arms 39 support the roller assembly 36 distal the pivot shaft 37. The counterweight 41 must be heavy enough to bias the roller assembly 36 upwardly such that a predetermined downward force, for example 40 lbs., is required to force the roller assembly 36 downwardly. A stop 45 on carriage 24 arrests the downward motion of the counterweight 41 to prevent the roller assembly 36 from pressing against the unndeflected supporting cover 13.

Figure 2:
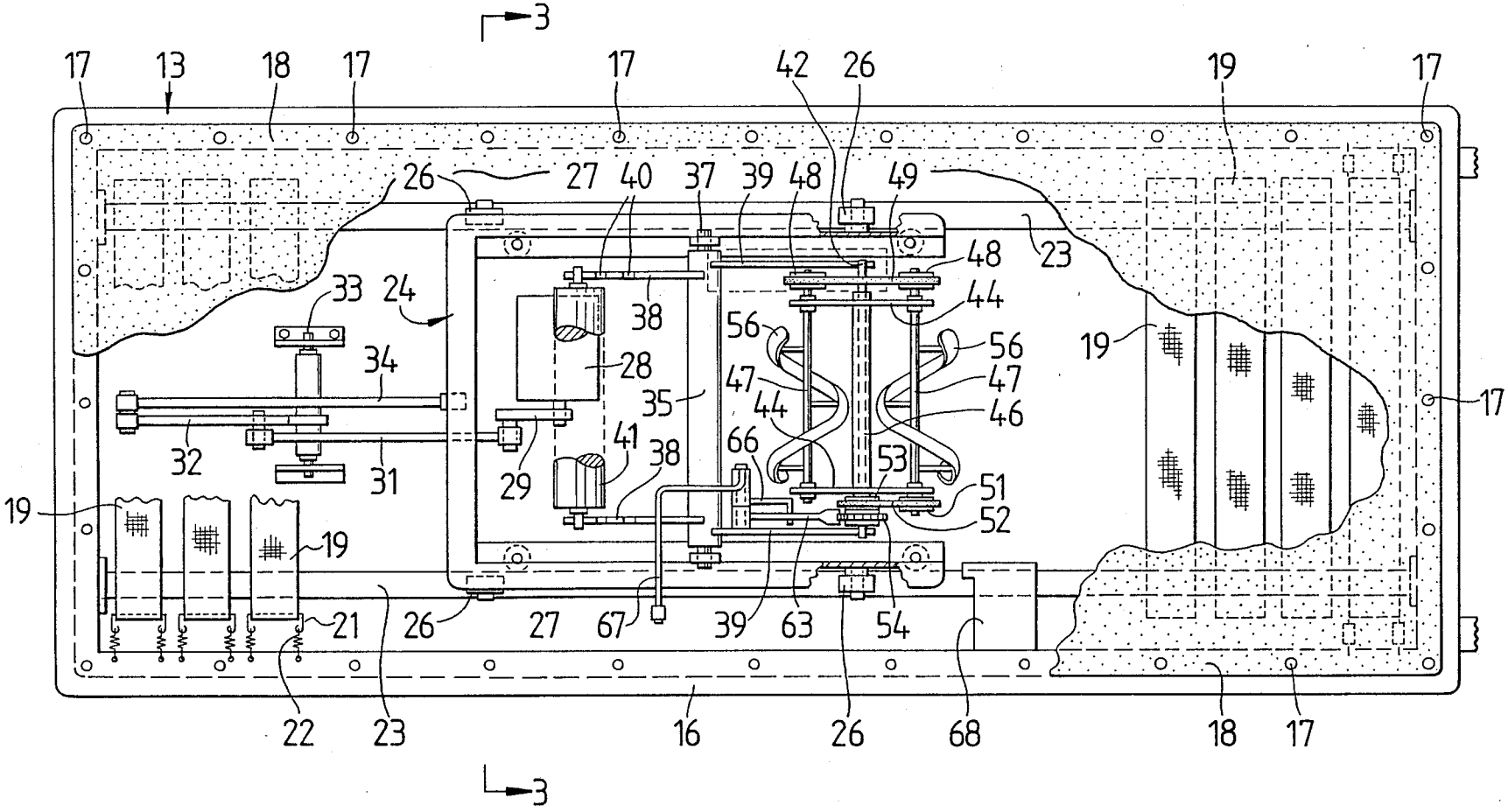
FIG. 2 is a plan view of the apparatus with the supporting cover partially omitted to reveal the mechanism.
Figure 4:
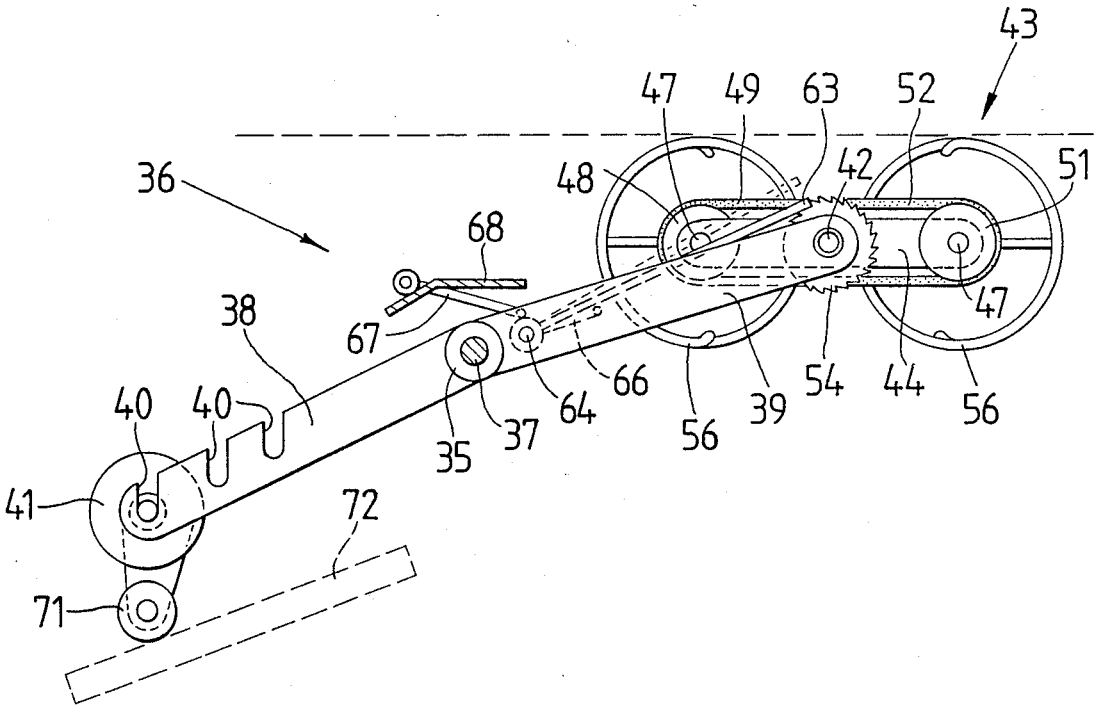
FIG. 4 is a detail elevational view of the roller mechanism and support structure therefor.

The embodiment shown in FIGS. 2–4 utilizes a tandem roller configuration. In this embodiment a shaft 42 extends between the arm 39 and pivotally supports a tandem roller frame 43. The tandem roller frame 43 includes a pair of end plates 44 mounted on a torque tube 46 on shaft 42. A pair of roller shafts 47 are carried by the frame and extend therethrough. Each shaft 47 carries a coupling pulley 48 on one end which engages a coupling belt 49 connecting the two shafts 47 for concomitant rotation. The other end of one of the shafts carries a braking pulley 51 which is connected by a braking belt 52 to a second braking pulley 53 mounted for rotation on shaft 42. The second braking pulley 53 is mated with a ratchet 54 which is also rotatable about shaft 42. The purposes of the braking pulleys and ratchet 54 will become apparent hereinafter.

Figure 5:
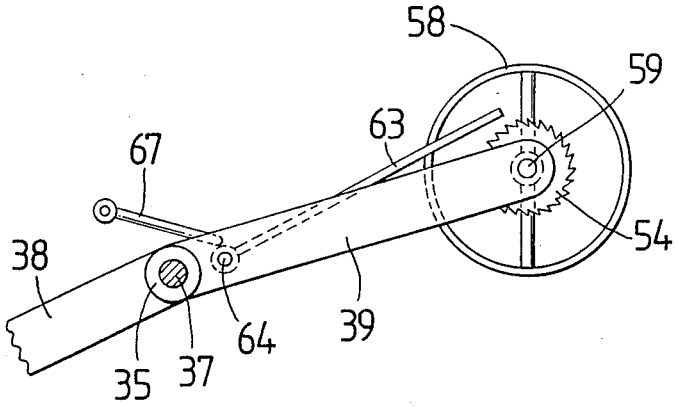
FIG. 5 is a detail elevational view of a second embodiment of the roller mechanism.
Figure 6:
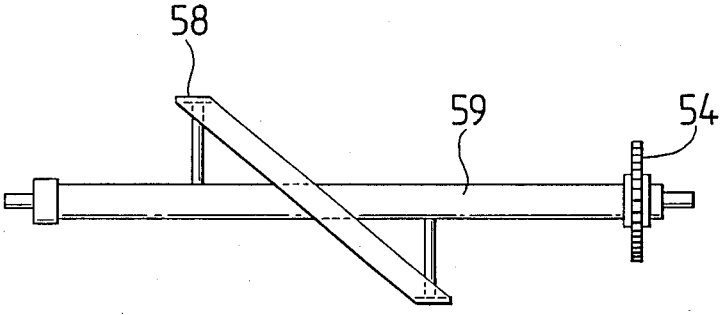
FIG. 6 is a side elevational view of the roller of FIG. 5.
Figure 7:
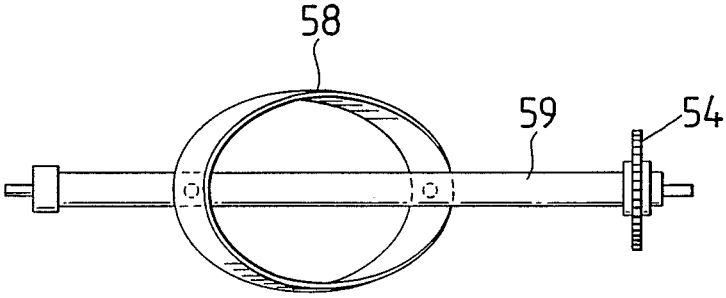
FIG. 7 is a side elevational view of the roller of FIG. 5 rotated 90° from the view in FIG. 6.

Each roller shaft 47 carries thereon an arcuate tread 56 spaced from the shaft 47 a distance sufficient to allow the tread 56 to define the only points of contact between the roller assembly 36 and the supporting cover 13. In the tandem roller configuration the treads 56 are each formed in the shape of a helix, with one being right handed and the other left handed. The helixes are positioned on the shafts 47 such that each helix contacts the underside of the supporting cover 13 at only one region of tangency, thus only two points of contact exist at any one time. By virtue of the pivotal mounting of the roller frame 43 each tread may be displaced but the upward pressure applied by the counterweight is evenly distributed. In an alternative embodiment, shown in FIGS. 5–7 a single tread 58 is carried on a roller shaft 59 mounted for rotation at the ends of the arms 39. The roller shaft 59 has mounted directly thereto the ratchet 54. In this embodiment, the preferred tread design forms an ellipse such that only one point on the tread contacts the underside of the supporting cover 13. In either embodiment the treads are about one inch wide and may be defined by visualizing them as lying within the surface of a cylinder of approximately five to seven inches in diameter.

Normally, when there is no weight on the supporting cover 13, the treads 56 or 58 move along the underside of the straps 19, with minimal contact therebetween. When a person lies on the bed, the bed surface and the tread is displaced by the person's body with the tread resisting this displacement in accordance with the upward force provided by the counterweight 41. As the carriage moves the roller assembly 36 along the person's body the roller shafts 42, 47 and treads 56, 58 turn such that a different region of the tread comes into contact with the straps 19. Thus the point of contact moves longitudinally and laterally as the carriage moves longitudinally.

Figure 8:
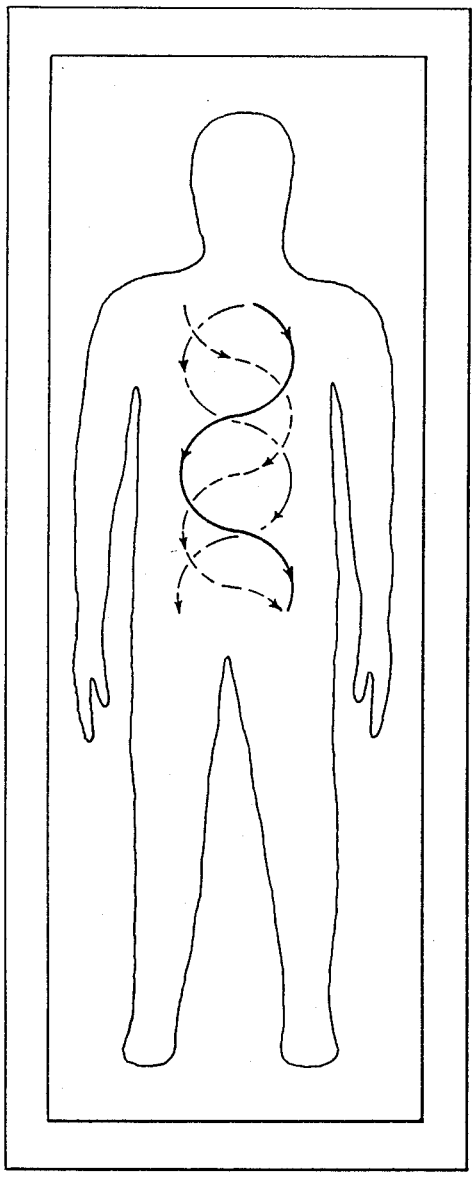
FIG. 8 depicts the paths traversed by the pressure point applied by the roller shown in FIGS. 5–7.
Figure 9:
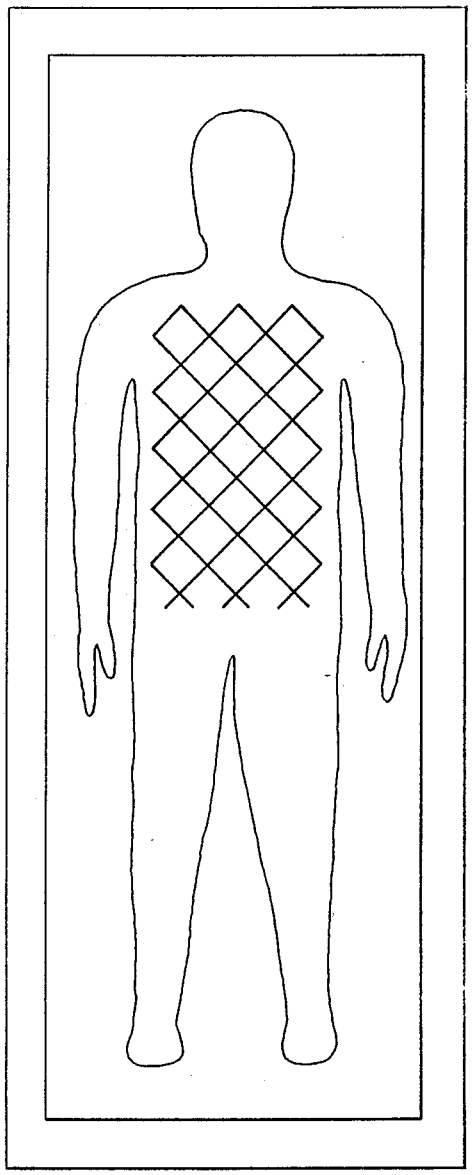
FIG. 9 depicts the paths traversed by the pressure point applied by the roller shown in FIGS. 2–4.

When using this device which applies pressure along a path on the user's body, it is desirable that the path of pressure be varied. To accomplish this I use the ratchet 54 and a pawl 63 to act as a brake to arrest the rotation of the roller assembly 36 over a portion of the carriage travel. The resultant paths are illustrated in FIGS. 8 and 9. The pawl 63 is pivotally mounted on a shaft 64 and is normally supported by a pawl support arm 66 which is counter-balanced by a pawl trip arm 67 relative to shaft 64. A pawl trip bracket 68 is supported on frame 12 and acts as a cam surface to raise pawl trip arm 67 and thus lower the pawl 63 into engagement with the ratchet 54. Rotation of the roller assembly 36 is thus arrested as the carriage completes its linear motion and resumes in the opposite direction as the carriage reverses itself.

At times it will be convenient for the user to use the bed without the roller assembly 36. To remove the roller assembly 36 from contact with the straps 19 and thus the user, I employ a counterweight lift roller 71 affixed to the counterweight arms 38. An inclined rail 72 is cooperatively positioned to act as a cam surface for this roller to raise the counterweight 41 and thus lower the roller assembly whereupon the motor 28 may be turned off and the roller assembly will remain displaced from the straps 19. The inclined rail 72 is pivotally mounted for lateral displacement about a pin 73 by handle 74 so that the roller assembly 36 is only lowered when desired.

From the foregoing it may be seen that I have provided a massaging bed on which a person may receive a deep penetrating massage along the buttocks, back and shoulders. By changing the counterweight or the position of the counterweight on its supporting arm, the pressure applied by the massaging roller assembly 36 may be adjusted to meet the individual's desires. The helical or elliptical tread may be changed to vary the pattern of the massage as well as its intensity.

While I have shown my invention in two forms, it will be obvious to those skilled in the art that it is not so limited but is susceptible of various changes and modifications without departing from the spirit thereof.

What I claim is:

1. Apparatus for massaging the back of an individual comprising:

(a) a frame supporting a flexible cover upon which the individual may rest;

(b) a reciprocating carriage mounted to said frame beneath said cover for driven reciprocation longitudinally along said frame;

(c) roller means, mounted for concomitant movement with said carriage, for point contact with the underside of said flexible cover along a substantially non-repeating path including at least one arcuate tread mounted in spaced relation on a shaft for rotation about the axis of said shaft, said arcuate tread having a center of curvature coincident with the axis of said shaft, with said arcuate tread extending about said shaft at an oblique angle thereto such that a different region of said tread comes into contact with said flexible cover and the point of contact moves laterally and longitudinally with respect to said flexible cover as said carriage reciprocates; and (d) means for biasing said arcuate tread against said flexible cover.

2. Apparatus as defined in claim 1 means for arresting the rotation of said arcuate tread over a predetermined portion of said carriage reciprocation such that lateral movement of said point of contact is also arrested while longitudinal movement of said point of contact continues.

3. Apparatus as defined in claim 2 wherein said means for arresting the rotation of said arcuate tread comprises:

(a) a ratchet-like member connected to said shaft for rotation therewith;

(b) a pivotally mounted pawl element engagable with said ratchet; and (c) means for selectively urging said pawl element into a position to engage said ratchet.

4. Apparatus as defined in claim 3 wherein said means for selectively urging comprises a pawl lift arm pivotally mounted with said pawl element and a counterbalancing weight, with said weight urging said lift arm and said pawl element toward said position; a cam surface mounted to said frame to support said counterbalancing weight within said predetermined portion of said carriage reciprocation.

5. Apparatus as defined in claim 3 wherein said arcuate tread comprises an elliptical band lying in a plane obliquely of the axis of said shaft such that rotation of said shaft and movement of said carriage causes said point of contact to move along a sinusoidal path beneath said flexible cover.

6. Apparatus as defined in claim 3 wherein said arcuate tread comprises a helical band having a center of curvature coincident the axis of said shaft such that rotation of said shaft and reciprocation of said carriage cause said point of contact to move diagonally relative to said flexible cover.

7. Apparatus as defined in claim 6 further comprising a ratchet shaft supporting said ratchet-like member for rotation and a frame pivotally mounted on said ratchet shaft to support said arcuate tread.

8. Apparatus as defined in claim 2 wherein said arcuate tread comprises an elliptical band lying in a plane obliquely of the axis of said shaft such that rotation of said shaft and movement of said carriage causes said point of contact to move along a sinusoidal path beneath said flexible cover.

9. Apparatus as defined in claim 2 wherein said arcuate tread comprises a helical band having a center of curvature coincident the axis of said shaft such that rotation of said shaft and reciprocation of said carriage cause said point of contact to move diagonally relative to said flexible cover.

10. Apparatus as defined in claim 2 wherein said biasing means comprises:

(a) a shaft member pivotally supported by said carriage transversely thereof;

(b) a pair of support arms connected at one end to said shaft member and adapted at the other end thereof to support said roller means;

(c) a pair of counterweight arms affixed at one end to said shaft and adapted at the other end thereof to carry a counterweight such that the weight and moment arm of said counterweight and roller means yields a resultant upward force on said roller means.

11. Apparatus as defined in claim 10 further comprising a cam roller depending from said counterweight arms; and a cam surface selectively movable to a cam roller engaging position and a disengaging position, such that in said engaging position said counterweight arms are supported on said cam roller and said cam surface, thereby removing said roller means from contact with said flexible cover.

12. Apparatus as defined in claim 10 further comprising means for selectively retracting said roller means from engagement with said flexible cover.

13. Apparatus as defined in claim 1 wherein said biasing means comprises:

(a) a shaft member pivotally supported by said carriage transversely thereof;

(b) a pair of support arms connected at one end to said shaft member and adapted at the other end thereof to support said roller means;

(c) a pair of counterweight arms affixed at one end to said shaft and adapted at the other end thereof to carry a counterweight such that the weight and movement arm of said counter weight and roller means yields a resultant upward force urging said roller means against said flexible cover.

14. Apparatus as defined in claim 13 further comprising means for selectively retracting said roller means from engagement with said flexible cover.

15. A massaging bed comprising:

(a) a frame;

(b) a flexible cover supported by said frame; and (c) massaging means for applying point pressure to the underside of said flexible cover along substantially non-repeating paths of movement defined by generally simultaneous lateral and longitudinal movement of said point pressure including at least one arcuate tread mounted in spaced relation on a transverse shaft for concomitant rotation with said shaft about the axis of said shaft, said arcuate tread having a center of curvature coincident with the axis of said shaft, with said arcuate tread extending about said shaft at an oblique angle thereto such that a different region of said tread comes into contact with said flexible cover and the point of contact moves laterally and longitudinally with respect to said flexible cover responsive to movement of said shaft longitudinally of said flexible cover.

16. A massaging bed as defined in claim 15 wherein said massaging means further comprises:

(a) a carriage mounted for driven longitudinal movement along said frame; and (c) biasing means for supporting said shaft on said carriage with said arcuate tread bearing against said underside with a predetermined force.

17. A massaging bed as defined in claim 16 further comprising means for arresting the rotation of said shaft and arcuate tread over a predetermined portion of the longitudinal movement of said carriage such that no lateral movement of said point pressure occurs.

* * * * *